US006726441B2

(12) United States Patent
Sumser et al.

(10) Patent No.: US 6,726,441 B2
(45) Date of Patent: Apr. 27, 2004

(54) COMPRESSOR, IN PARTICULAR FOR AN INTERNAL COMBUSTION ENGINE

(75) Inventors: Siegfried Sumser, Stuttgart (DE); Peter Fledersbacher, Stuttgart (DE); Wolfgang Erdmann, Stuttgart (DE); Helmut Finger, Leinfelden-Echterdingen (DE); Friedrich Wirbeleit, Esslingen (DE)

(73) Assignee: Daimler Chrysler AG, Stuttgart (DE)

( * ) Notice: Subject to any disclaimer, the term of this patent is extended or adjusted under 35 U.S.C. 154(b) by 112 days.

(21) Appl. No.: 10/068,554

(22) Filed: Feb. 6, 2002

(65) Prior Publication Data

US 2002/0106274 A1 Aug. 8, 2002

(30) Foreign Application Priority Data

Feb. 7, 2001 (DE) ..... 101 05 456

(51) Int. Cl.[7] ..... F04D 29/66

(52) U.S. Cl. ..... 415/56.5; 415/57.4; 415/58.3; 415/58.6

(58) Field of Search ..... 415/52.1, 56.5, 415/57.4, 58.3, 58.4, 58.6, 58.2, 143, 182.1, 223

(56) References Cited

U.S. PATENT DOCUMENTS

| | | | | |
|---|---|---|---|---|
| 4,212,585 A | | 7/1980 | Swarden et al. | |
| 4,930,979 A | * | 6/1990 | Fisher et al. | 415/58.4 |
| 6,447,241 B2 | * | 9/2002 | Nakao | 415/1 |

FOREIGN PATENT DOCUMENTS

| | | |
|---|---|---|
| DE | 42 13 047 | 10/1993 |
| DE | 198 23 274 | 10/1999 |
| GB | 2 220 447 | 1/1990 |
| GB | 2 363 427 | 12/2001 |

* cited by examiner

*Primary Examiner*—Edward K. Look
*Assistant Examiner*—Dwayne J. White
(74) *Attorney, Agent, or Firm*—Klaus J. Bach

(57) ABSTRACT

In an air compressor, particularly for an internal combustion engine, which has a compressor housing with a flow duct structure and a recirculation arrangement including a bypass structure for recirculation some of the air entering the compressor wheel, a recirculating ring is arranged in the bypass flow structure around the compressor wheel and the ring has a plurality of flow passages distributed uniformly around its circumference with inflow orifices at the radial inner end in communication with the compressor flow duct and outflow orifice at the radial outer end in communication with a by-pass flow space.

12 Claims, 3 Drawing Sheets

COMPRESSOR, IN PARTICULAR FOR AN INTERNAL COMBUSTION ENGINE

BACKGROUND OF THE INVENTION

The invention relates to a compressor, in particular for an internal combustion engine, with a compressor wheel disposed in a compressor flow duct and a recirculation structure.

German patent publication DE 42 13 047 A1 discloses an exhaust gas turbocharger for an internal combustion engine which turbocharger comprises a compressor driven by an exhaust gas turbine. For increasing the compressor working range, the compressor is equipped with a characteristic-diagram stabilization means for displacing the surge limit and the fill limit of the compressor. The characteristic-diagram stabilization means consists of a bypass in relation to the compressor flow duct in the compressor casing, which bypass extends approximately parallel to the compressor flow duct and bridges the inlet area of the compressor wheel. The bypass has the function of a recirculation device, by means of which a part of the mass flow entering the compressor can be returned in the opposite direction to the general flow direction, with the result that the surge limit of the compressor is displaced in favor of a greater working range.

The fill limit can also be changed in order to increase the power of the compressor or of the motor. The flow cross section of the compressor flow duct is enlarged via the bypass, so that additional intake air can be supplied to the compressor. The fill limit is thereby displaced in the direction of greater mass flows.

The geometry of the bypass has a decisive influence on the formation of the re-circulation flow when the compressor is operating near the surge limit. For an improved return flow through the bypass, it was proposed, for example in U.S. Pat. No. 4,122,585, to provide an annular bypass flow structure surrounding the compressor wheel and having a multiplicity of flow passages which are distributed over the circumference and extend approximately tangentially in the swirling direction of the compressor wheel. Each flow passage extends axially over a portion of the compressor wheel and bridges the compressor-wheel inlet area, so that circulating combustion air can be returned axially, via the flow passages, into the region upstream of the compressor-wheel inlet.

One disadvantage of this device, however, is that the tangential swirl of the recirculation flow can be utilized only inadequately for forming and maintaining a circulating mass flow, because the flow ducts are closed on their radially outer sides and the mass flow flowing into the tangential flow ducts is deflected, at the end of the flow ducts, in the direction opposite to the compressor inflow direction.

It is the object of the present invention to provide a compressor, which can be operated in a wide operating range, by means of simple structural means.

SUMMARY OF THE INVENTION

In an air compressor, particularly for an internal combustion engine, which has a compressor housing with a flow duct structure and a recirculation arrangement including a bypass structure for recirculation some of the air entering the compressor wheel, a recirculating ring is arranged in the bypass flow structure around the compressor wheel and the ring has a plurality of flow passages distributed uniformly around its circumference with inflow orifices at the radial inner end in communication with the compressor flow duct and outflow orifice at the radial outer end in communication with a by-pass flow space.

It is thereby possible for the returned exhaust gas mass flow to be guided through the circulation ring radially from the inside outwards and to flow into the bypass flow space which surrounds the recirculation ring radially. The mass flow introduced into the recirculation device flows, under the influence of the centrifugal co-swirl flow, through the recirculation ring with a radial component, is subsequently collected in the annular bypass flow space and is finally returned axially into the compressor flow duct. There is no repulsion, which would detrimentally affect the co-swirl flow.

The recirculation ring may be designed as a separate component, which is to be inserted into the bypass. The recirculation ring is dimensioned such that a bypass flow space remains in the bypass which flow space surrounds the recirculation ring radially for receiving the returning mass flow.

In an expedient embodiment, the flow passages in the recirculation ring extend axially only over a portion of the axial width of the ring. The mass flow introduced into the recirculation ring is thereby prevented from flowing out axially at the axially closed side of the ring, thus necessitating an outflow with a radial component. The recirculation ring is expediently provided with flow passages, which are delimited on the opposite axial sides of the ring by wall portions, so that any axial inflow and outflow are prevented. As a result, flow turbulences can be avoided, and the co-swirl flow generated as a result of the rotation of the compressor wheel can be utilized optimally for the radial flow through the recirculation ring.

Advantageously, at least some of the flow passages extend rectilinearly, whereby manufacturing is simplified. Additionally or alternatively, however, it may also be expedient to make some or all of the flow ducts curved, wherein the curvature of the flow passages preferably follows the curvature of the compressor wheel. If both, rectilinear and curved, flow passages are provided, it may be advantageous, for the purpose of simplifying the production process, if the passages have a cross-section, which is constant over their length. It may also be expedient, however, to provide a flow cross-section, which narrows toward the radially outer end of the recirculation ring, whereby a nozzle effect is achieved for the recirculation flow.

The flow passages preferably extend in the swirling direction, the outflow orifice being arranged so as to be offset relative to the inflow orifice in the direction of the rotation of the compressor wheel. This results in the flow passages extending approximately tangentially with a radial component, so that the flow passages form an angle with the radial direction. In the case of a rectilinear design of the flow passages, the angle between the longitudinal axis of the flow passages and a tangent to the annular inside of the recirculation ring is advantageously about 20° to 60°. By contrast, with a curved flow passage, it may be expedient to provide the gradient of the flow passage in the region of its inflow orifice relative to the tangent to the annular inside of the recirculation ring with an inlet angle of 20° to 60° and the gradient in the region of the outflow orifice relative to a tangent to the annular outside of the recirculation ring with an outlet angle of between 10° and 50°. The outlet angle is smaller than the inlet angle, the outlet angle typically having a value of about 10° and the inlet angle a value of about 60°.

The invention will become more readily apparent from the following description of preferred embodiments, thereof shown, by way of example in the accompanying drawings.

DESCRIPTION OF PREFERRED EMBODIMENTS

In the following description identical components are designated by the same reference symbols.

Figure 1:
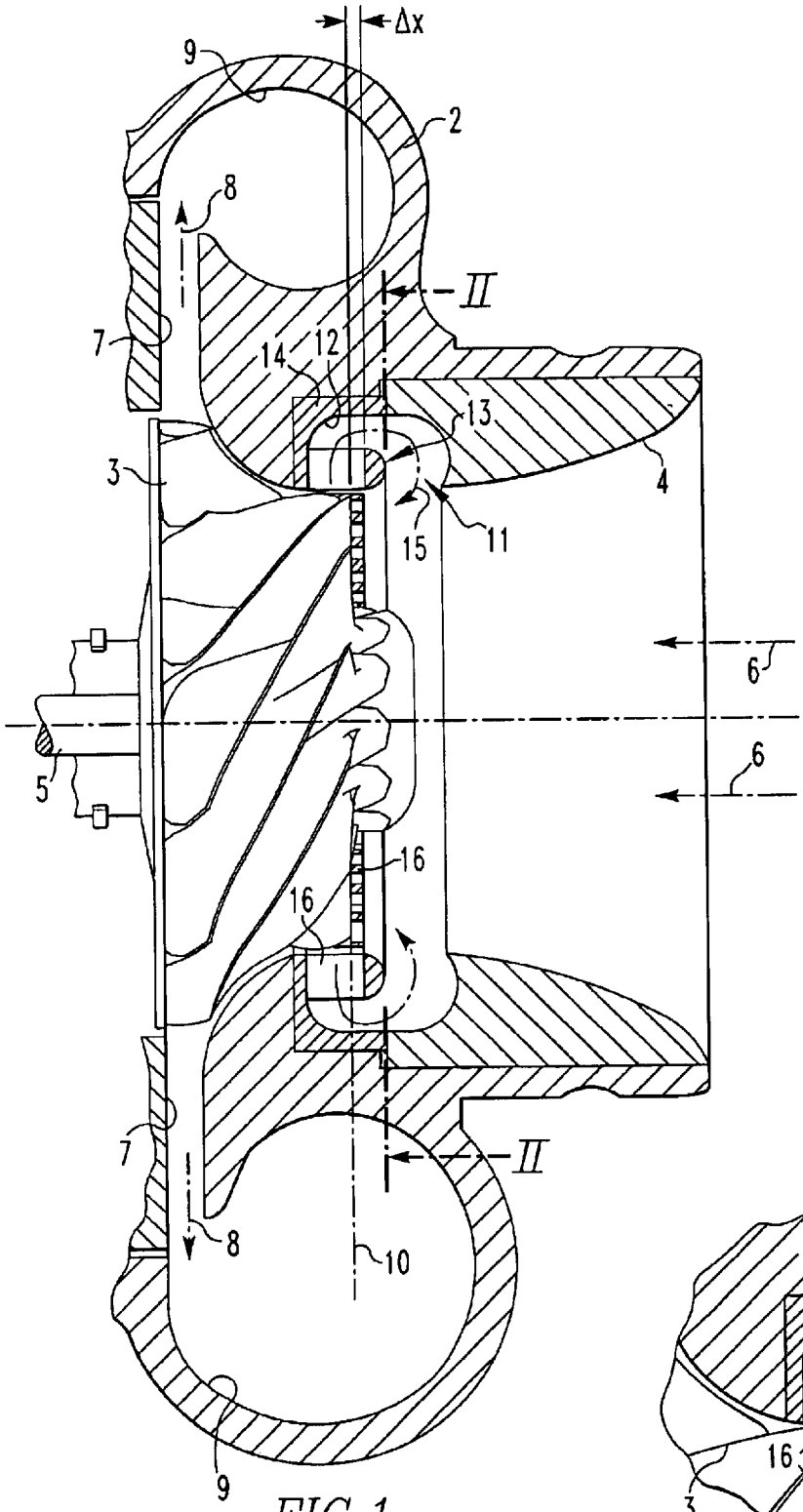
FIG. 1 is a sectional view of a compressor having a compressor wheel, which is surrounded by a recirculation ring.
Figure 1A:
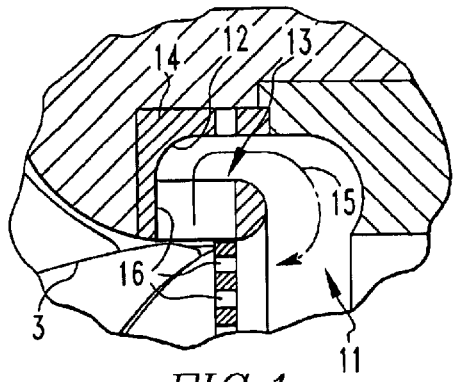
FIG. 1*a* is an enlarged sectional illustration of the recirculation ring of FIG. 1.

The compressor 1 illustrated in FIG. 1 and, in a detail, in FIG. 1*a*, is part of an exhaust gas turbocharger of an internal combustion engine. It is driven by an exhaust gas turbine of the exhaust gas turbocharger, which turbine is arranged in the exhaust tract of the engine and is acted upon by the exhaust gases, which are under excess pressure. The compressor 1, which in the exemplary embodiment is a radial compressor, is located in the intake tract of the internal combustion engine and compresses combustion intake air to an increased charge pressure with which the combustion air is fed to the combustion chambers of the internal combustion engine.

The compressor 1 comprises a compressor wheel 3, which is arranged in a compressor flow duct 4 in a casing 2 of the compressor and which is driven by the turbine of the exhaust gas turbocharger via a shaft 5. When the compressor 1 is in operation, combustion air is sucked into the compressor flow duct 4 in the direction of the arrow 6, compressed to an increased charge pressure by the rotating compressor wheel 3 and conducted, via a diffuser 7, in the direction of the arrow 8 into a spiral duct 9 in the casing 2 of the compressor. From there, the compressed air is normally conducted to a charge air cooler for cooling, and is then fed via the intake tract of the internal combustion engine to the engine inlet.

Located in the inflow region of the flow duct 4 near the compressor-wheel inlet end 10 is a recirculation device 11, which makes it possible to recirculate combustion air sucked into the compressor flow duct 4 in a direction opposite to the main flow direction, identified by the arrow 6, of the combustion air. In this way, the surge limit of the compressor can be displaced in favor of lower mass flows, so that the useful operating range of the compressor is increased. The recirculation device 11 surrounds the compressor wheel 3 annularly in the region near the inlet end 10 of the compressor-wheel. The recirculation device 11 of a bypass 12 and of a recirculation ring 13 which is arranged in the bypass 12 and which radially closely surrounds the compressor wheel 3. Its main body projects axially beyond the compressor-wheel inlet end 10 by an amount $\Delta x$. The bypass 12 is formed in a half-sidedly open annular flange 14, which delimits the space of the bypass axially inwardly and radially outwardly. The recirculation device 11 makes it possible for a partial mass flow of the sucked-in combustion air to flow back, according to the arrow 15, out of a part of the compressor flow duct 4, in which the compressor wheel 3 rotates, into an area of the inlet duct 4 just upstream of the compressor-wheel inlet end 10. For this purpose, as a result of the flow swirl of the rotating compressor wheel 3, a partial mass flow is first conducted radially outwardly through flow passages 16 in the recirculation ring 13. Then, it is directed through the bypass 12, where the partial mass flow is deflected in the axial direction and, finally, is returned, in the direction opposite to the main flow direction indicated by arrow 6, into the flow duct 4 upstream of the inlet end 10 of the compressor wheel 3.

By virtue of the red recirculation 13 projecting axially beyond the compressor-wheel inlet end 10 in the direction of the inflow orifice in the flow duct 4 by the amount $\Delta x$, some of the circulated partial mass flow can be returned radially inwardly into the flow duct 4 in the region of the projection. Since the flow passages 16 in the recirculation ring 13 are delimited axially at both axial ends, it is not possible, in this version, for the returned mass flow to escape axially.

Figure 2:
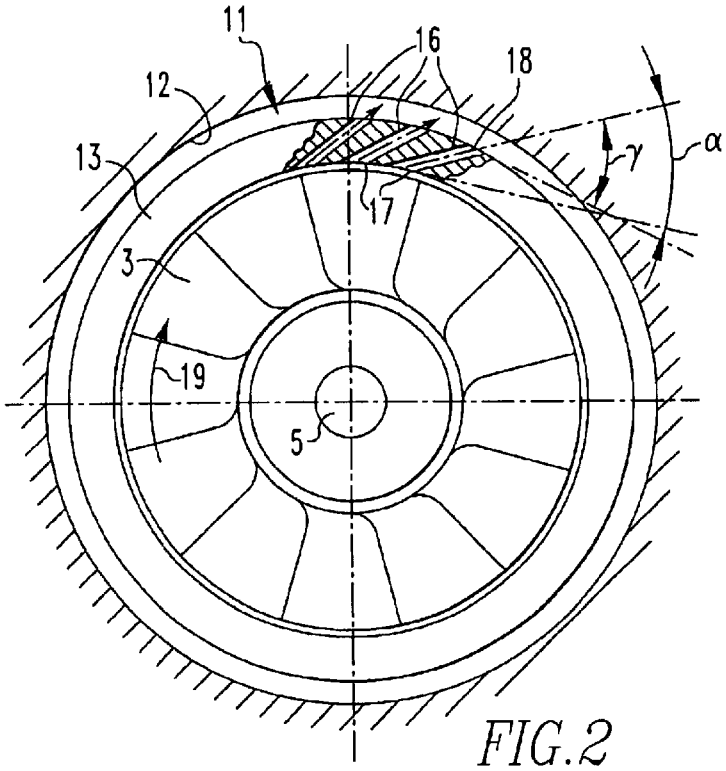
FIG. 2 is a view of the recirculation ring and the compressor wheel taken along the sectional line II—II of FIG. 1, the recirculation ring being partially cut away in order to show the rectilinearly designed flow passages.

As apparent from FIG. 2, a multiplicity of identical flow passages 16 are provided, distributed uniformly over the circumference of the recirculation ring 13. The flow passages 16 extend radially through the recirculation ring 13 and have inflow orifices 17 on the radial inner side of the ring and outflow orifices 18 on the radial outer side of the ring. The inflow orifices 17 communicate with the flow duct, that is, the annular space around the compressor wheel 3 and the outflow orifices 18 communicate with the surrounding annular bypass 12. The rectilinearly flow passages 16 have a constant cross section over their entire length. Each outflow orifice 18 of a flow passage 16 is arranged, offset relative to its inflow orifice 17, in the direction of rotation 19 of the compressor wheel 3, so that the flow passages 16, extend tangentially with respect to a virtual circle enclosing the adjacent compressor wheel area. Each flow passage 16 forms, relative to a tangent to the radial inside of the recirculation ring 13, an inflow angle $\alpha$ of about 25°. Each flow duct 16 forms, relative to a tangent to the radial outside of the recirculation ring 13, an outflow angle $\gamma$, which is preferably larger than the inflow angle $\alpha$ and is about 40°.

In a particular embodiment of the invention, the rectilinear flow passages 16 become narrower in cross-section from the inflow orifice 17 to the outflow orifice 18, so that a nozzle effect for the outwardly guided mass flow is achieved.

Figure 3:
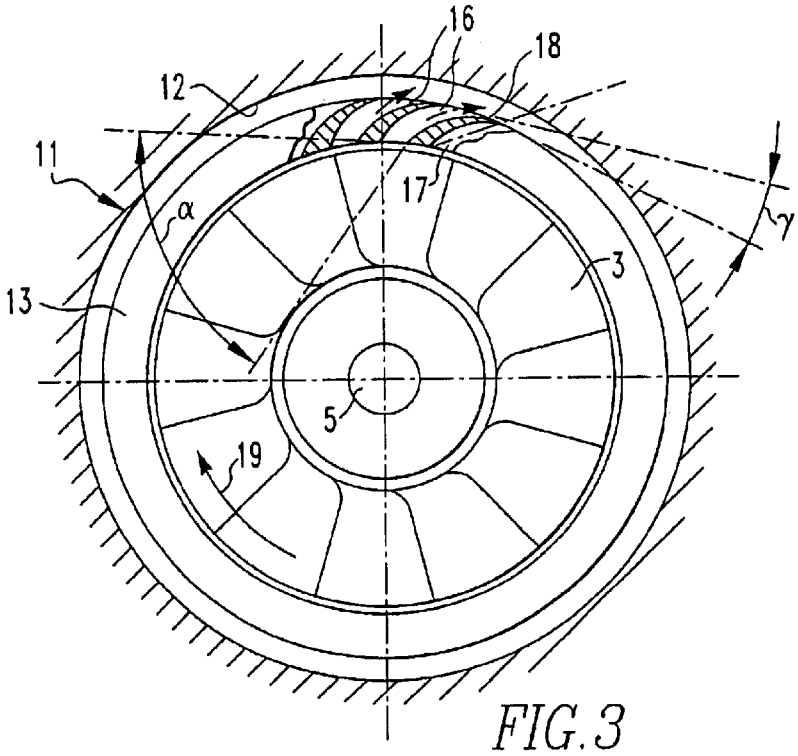
FIG. 3 shows an illustration corresponding to that of FIG. 2, wherein however the flow passages are curved.

In another embodiment of a recirculation ring 13 as illustrated in FIG. 3, the flow passages 16 are curved, the direction of curvature coinciding with the direction of curvature of the compressor wheel. The compressor wheel and flow passages are oriented in the same direction. Each flow passage 16 has a constant cross section over its extent, however, a narrowing cross-section may be provided in order to achieve a nozzle effect. By virtue of the curved flow passages 16, the inflow angle $\alpha$, measured between the gradient of the flow duct 16 in the region of the inflow orifice 17 and a tangent to the radial inside of the recirculation ring, is larger than the outflow angle $\gamma$, measured between the gradient in the region of the outflow orifice 18 and a tangent in the region of the radial outside of the recirculation ring. In the exemplary embodiment shown, the inflow angle $\alpha$ is about 60° and the outflow angle $\gamma$ is about 15°.

Figure 4:
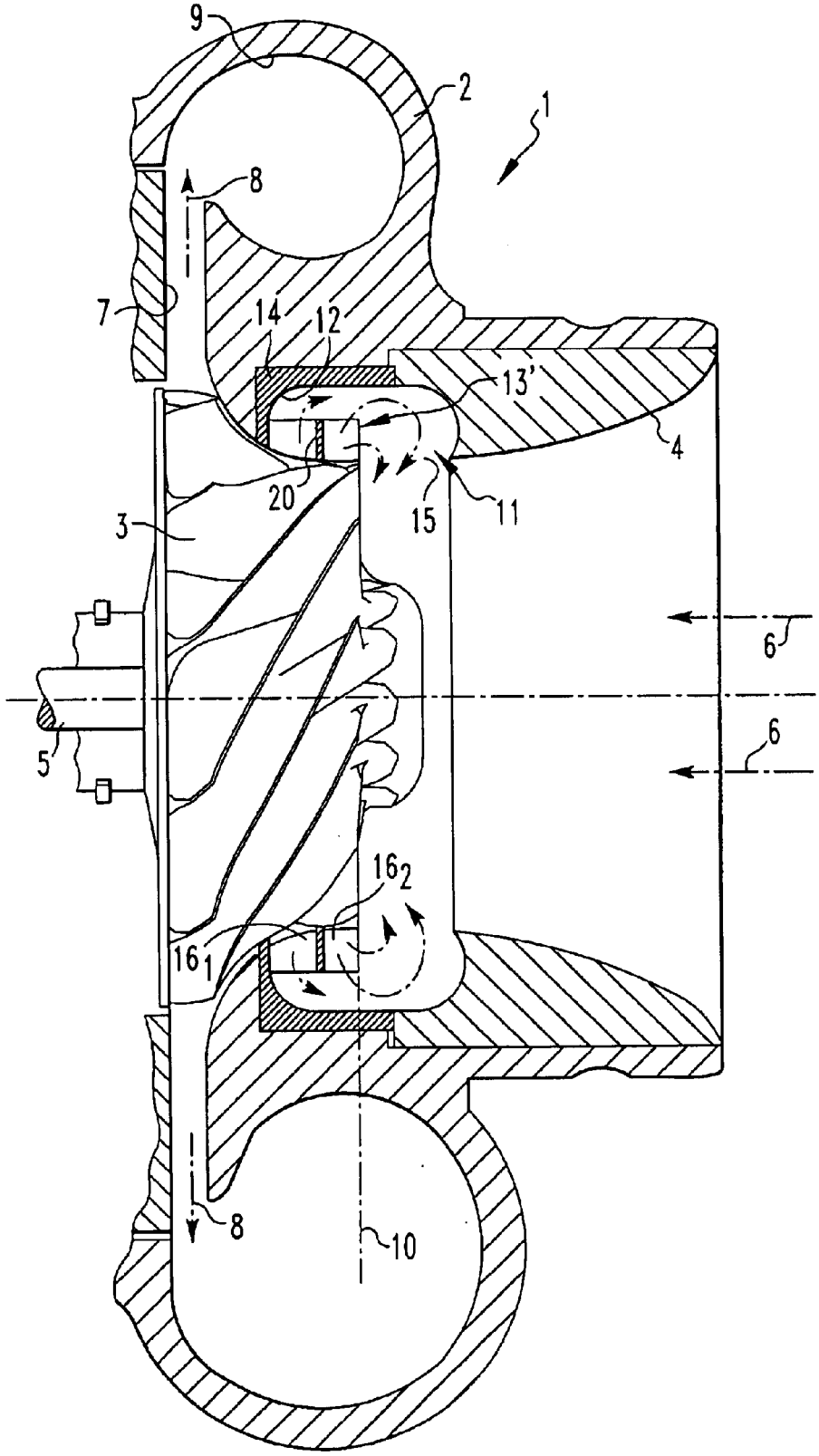
FIG. 4 shows an illustration, corresponding to that of FIG. 1, of a compressor with a modified version of a recirculation ring.

FIG. 4 shows a modified version of a compressor 1 with a recirculation ring 13' as an integral part of the recirculation device 11. The recirculation ring 13' is axially flush with a compressor-wheel inlet end 10 of the compressor wheel 3. In contrast to the recirculation ring of FIG. 1, in this case, first flow passages $\mathbf{16}_1$ and second flow passages $\mathbf{16}_2$, arranged offset in parallel in two axial planes, are distributed uniformly over the circumference of the recirculation ring 13'. The flow passages $\mathbf{16}_2$ adjacent to the compressor-wheel inlet end 10 are open axially in the direction of the entrance of the compressor flow duct 4, so that the partial mass flow returned through the second flow passages $\mathbf{16}_2$ can be returned both radially outwards and axially into a portion of the flow duct 4 upstream of the compressor wheel 3. First flow passages $\mathbf{16}_1$ and second flow passages $\mathbf{16}_2$ are separated by an axial partition 20, with the result that direct gas exchange between the first and second flow passages $\mathbf{16}_1$ and $\mathbf{16}_2$ is prevented and an outflow, directed solely radially outwardly from the first flow passage $\mathbf{16}_1$ is achieved. Both the first flow passage $\mathbf{16}_1$ and the second flow passages $\mathbf{16}_2$ may otherwise be designed in the above-described way, as stated with regard to FIGS. 1 to 3.

The above-described compressor may also be a component, which is driven mechanically by the internal combustion engine and the drive power of which is derived indirectly or directly from the crankshaft of the internal combustion engine. Alternatively to this, a motor drive, in particular an electric motor drive, is also possible. In the case of a mechanical or motor drive, an exhaust gas turbine may be dispensed with.

The above-described statements also apply in a similar way to compressors, which are used independently of internal combustion engines.

What is claimed is:

1. An air compressor, in particular for an internal combustion engine, comprising a housing with a flow duct structure, a compressor wheel with an inlet end rotatably supported in said flow duct structure, a recirculation arrangement including a bypass structure with a bypass flow area for recirculating some of the air from the compressor wheel back to the compressor inlet end and including a recirculation ring arranged in said bypass structure around said compressor wheel, said recirculation ring having a plurality of flow passages distributed uniformly around the circumference of said recirculation ring and having at the radial inner end of the recirculation ring adjacent the compressor wheel inflow orifices in communication with the compressor flow duct and outflow orifices at the radially outer end of the recirculation ring in communication with the bypass flow area, said flow passages extending in a direction deviating from the radial direction such that the outflow orifice are circumferentially offset relative to the respective inflow orifices in the direction of rotation of the compressor wheel.

2. A compressor according to claim 1, wherein said flow passages extend axially only over a portion of the axial width of the recirculation ring.

3. A compressor according to claim 1, wherein said flow passages have, in the region of their inflow orifices, a direction which forms, with a tangent to the annular inside of the recirculation ring, an inlet angle a of 20° to 60°.

4. A compressor according to claim 1, wherein said flow passages have, in the region of their outflow orifice, a direction which forms with a tangent to the annular outside of the recirculation ring an outlet angle $\gamma$ of between 10° and 50°.

5. A compressor according to claim 1, wherein said flow passages extend rectilinearly.

6. A compressor according to claim 1, wherein said flow passages are curved.

7. A compressor according to claim 1, wherein said recirculation ring projects axially beyond the compressor-wheel inlet end.

8. A compressor according to claim 1, wherein flow passages are provided in the recirculation ring axially adjacent each other in at least two ring planes.

9. A compressor according to claim 1, wherein at least some of the flow passages have, over at least a radially outer portion, axial communication orifices on the side axially facing the compressor flow duct.

10. A compressor according to claim 1, wherein all the flow passages in said recirculation ring are of identical shape.

11. A compressor according to claim 1, wherein said flow passages have uniform cross-sections over their length.

12. A compressor according to claim 1, wherein said flow passages have a cross-section which narrows toward their outflow orifices.

* * * * *